US008075342B1

(12) United States Patent
Harney et al.

(10) Patent No.: US 8,075,342 B1
(45) Date of Patent: Dec. 13, 2011

(54) AMPLIFYING CONNECTOR

(75) Inventors: Michael Harney, Pleasant Grove, UT (US); Mario Ninic, Sandy, UT (US); Rory Howard, Layton, UT (US); Kim Mansfield, Lehi, UT (US)

(73) Assignee: R&M Tone Technology, Layton, UT (US)

( * ) Notice: Subject to any disclaimer, the term of this patent is extended or adjusted under 35 U.S.C. 154(b) by 0 days.

(21) Appl. No.: 12/553,910

(22) Filed: Sep. 3, 2009

Related U.S. Application Data

(60) Provisional application No. 61/093,973, filed on Sep. 3, 2008.

(51) Int. Cl.
*H01R 9/00* (2006.01)

(52) U.S. Cl. ..... 439/620.01

(58) Field of Classification Search ..... 439/620.01
See application file for complete search history.

(56) References Cited

U.S. PATENT DOCUMENTS 4,000,475 A * 12/1976 Oiwa ..... 330/66
4,090,033 A * 5/1978 Silverstein ..... 381/75
4,896,360 A * 1/1990 Knight ..... 381/82
6,262,993 B1 * 7/2001 Kirmse ..... 370/463
7,577,983 B2 * 8/2009 Shapson ..... 725/149
2003/0113263 A1 * 6/2003 Marks et al. ..... 424/9.2
2005/0237068 A1 * 10/2005 Nakashita et al. ..... 324/539
2008/0123874 A1 * 5/2008 Chiu ..... 381/120
2010/0144293 A1 * 6/2010 Yoshino et al. ..... 455/150.1

* cited by examiner

*Primary Examiner* — Gary F. Paumen

(57) ABSTRACT

Disclosed is an amplifying connector. The amplifying connector comprises (a) a connector body; (b) an op amp forming an amplifier mounted to the connector body; (c) a power supply circuit mounted to the connector body and coupled to the amplifier; (d) a connector output on the connector body coupled to an amplifier output of the amplifier; and (e) a connector input on the connector body coupled to an amplifier input of the amplifier. An input electrical signal on the connector input is buffered by the amplifier to generate an output electrical signal on the connector output to reduce effects caused by an impedance of the cable. The amplifier may be powered by a power supply circuit powers that draws a portion of the current or voltage from the input signal of a source electronic device, or by an on-board dedicated low power battery power supply.

22 Claims, 8 Drawing Sheets

AMPLIFYING CONNECTOR

CROSS REFERENCE TO RELATED APPLICATIONS

The present invention claims the benefit of U.S. Provisional Application Ser. No. 61/093,973, filed Sep. 3, 2008, and entitled, "Amplifying Connector," which is incorporated by reference herein in its entirety.

FIELD OF THE INVENTION

The present invention relates generally to connectors, cables, and circuitry for powering an amplifier in a connector.

BACKGROUND

Musical instruments that generate electrical signals, such as the electric guitar, are connected to amplifiers and sound systems using electrical cables. Often the distance between the guitar and the amplifier is significant. The electrical cables have capacitance that increases with cable length. The capacitance in the cable can cause a phase distortion or shift in the electrical signals generated from the musical instrument. The phase distortion can increase with the cable length and create a "muddy" sound. Sometimes an effects pedal (or a "Stomp Box") is used to modify the instrument's sound. The pedal is usually coupled between the musical instrument and the amplifier. Using the pedal may also adversely affect the sound of a musical instrument through the phenomena called "tone sucking."

Electric guitars and other stringed instruments can generate electrical signals using pickups. A pickup device acts as a transducer that captures mechanical vibrations (usually from suitably equipped stringed instruments such as the electric guitar, electric bass guitar or electric violin) and converts them to an electrical signal, which can be amplified and recorded. Pickup can be magnetic, piezoelectric, hexaphonic (divided or polyphonic), electromagnetic, or optical. A magnetic pickup consists of a permanent magnet wrapped with a coil of a few thousand turns of fine enameled copper wire. Pickups can be either active or passive. Pickups, apart from optical types, are inherently passive transducers. Active pickups can incorporate electronic circuitry to modify the signal. Active pickups can require an electrical source of energy to operate and include an electronic preamp, active filters, active equalization (EQ) and other sound-shaping features. Typically, 10% of pickups used are active. Passive pickups are usually wire wound around a magnet. Passive pickups can generate electric potential without need for external power, but their output is relatively low.

The frequency range for audible sound is about 20 Hz to 20 kHz for most individuals. This is referred to as the audible range. Pickups can generate a high frequency voltage sine wave in response to high frequency acoustic signals (i.e. sound) in the upper audible range (15-20 KHz) with an amplitude of approximately 60 to 100 mV peak-to-peak. The maximum voltage of a signal produced by a pickup in response to a high frequency acoustic signal may be 300 mV. Pickups can generate a low frequency voltage sine wave in response to an acoustic signal in the lower audible range (2-4 KHz) with an amplitude of approximately 1 V peak-to-peak. Pickups can generate greater voltage for low frequency acoustics than higher frequency acoustics.

Numerous pickups are available to musicians to vary the quality of the sound of their guitars. Different styles of music use different types of pickups. Pickups can be mounted on a musical instrument and are connected to sound equipment using cables. Cables have resistance, capacitance, and inductance, together referred to as the impedance, which can alter the characteristics of the electrical signal, and thus the sound amplified. Using an amplifier to buffer or amplify the generated signal may reduce the effects due to the impedance of the cable and other components, such as an effects pedal.

SUMMARY

In accordance with the invention as embodied and broadly described herein, the present invention features an amplifying connector for maintaining the purity of signal fidelity along the length of a cable. In one exemplary embodiment, the present invention resides in an amplifying connector operable with a cable electrically coupling first and second electronic devices, comprising an op amp forming an amplifier; a low wattage power supply circuit operable with the amplifier, wherein the power supply circuit facilitates powering of the amplifier; a connector output coupled to an amplifier output; and a connector input coupled to an amplifier input, wherein an input electrical signal on the connector input is buffered by the amplifier to generate an output electrical signal on the connector output having reduced effects caused by an impedance of the cable.

The present invention also resides in an amplifying cable electrically coupling first and second electronic devices, comprising a signal line and a common line; an input connector with an input connector body integrally formed with and supported at a first end of the amplifying cable; an op amp forming an amplifier having unity gain that is supported within the input connector body, wherein an amplifier input of the amplifier is electrically coupled to the signal line of the input connector; a low voltage power supply circuit supported within the input connector body and electrically coupled to the op amp, wherein the power supply circuit facilitates powering of the op amp, and wherein the amplifier and the low voltage power supply circuit form an amplifying connector; and an output connector integrally formed on a second end of the amplifying cable and electrically coupled to an amplifier output of the amplifier through the signal line of the amplifying connector, wherein the amplifying connector receives an input electrical signal and generates an output electrical signal at the output connector having reduced effects caused by an impedance of the cable.

The present invention further resides in an amplifying cable electrically coupling first and second electronic devices, comprising a signal line; an input connector having an input connector body; an amplifying connector integrally formed with and supported along a length of the cable, the amplifying connector comprising an amplifying connector body; an op amp forming a unity gain amplifier supported within the amplifying connector body, the op amp having an amplifier input coupled to the input connector through the signal line; a low voltage power supply circuit supported within the amplifying connector body and electrically coupled to the op amp, wherein the power supply circuit facilitates powering of the op amp; and an output connector coupled to an amplifier output of the op amp through the signal line, wherein the amplifying connector receives an input electrical signal and generates an output electrical signal at the output connector having reduced effects caused by an impedance of the cable.

The present invention still further resides in an amplifying connector, comprising a connector body; an op amp forming a unity gain amplifier supported within the connector body; an input signal-to-power generating circuit supported within the connector body to power the op amp using a signal voltage of less than one volt; a connector input on the connector body coupled to an amplifier input of the amplifier; and a connector output on a connector body coupled to an amplifier output of the amplifier, wherein an input electrical signal on the connector input is buffered by the amplifier to generate an output electrical signal on the connector output having reduced effects caused by an impedance of the cable.

The present invention still further resides in an amplifying connector, comprising a connector having a signal line and a common line supported within a connector body; an op amp forming a unity gain amplifier supported within the connector body; a low power battery power supply operable within the connector body that powers the op amp, wherein the low power battery power supply is configured to draw less than 60 microwatts; a connector input on the connector body coupled to an amplifier input of the unity gain amplifier; and a connector output on the connector body coupled to an amplifier output of the unity gain amplifier, wherein an input electrical signal on the connector input is buffered by the unity gain amplifier to generate an amplified output electrical signal on the connector output having reduced effects caused by an impedance of the cable.

Methods of maintaining the purity of the signal fidelity along a cable between first and second electronic devices are also contemplated. For example, the present invention resides in a method for reducing effects caused by impedance within a cable, the method comprising providing an op amp forming an amplifier within the cable; powering the op amp; and providing an input electrical signal that is buffered by the amplifier to generate an output electrical signal.

BRIEF DESCRIPTION OF THE DRAWINGS

The present invention will become more fully apparent from the following description and appended claims, taken in conjunction with the accompanying drawings. Understanding that these drawings merely depict exemplary embodiments of the present invention they are, therefore, not to be considered limiting of its scope. It will be readily appreciated that the components of the present invention, as generally described and illustrated in the figures herein, could be arranged and designed in a wide variety of different configurations. Nonetheless, the invention will be described and explained with additional specificity and detail through the use of the accompanying drawings in which:

Figure 1:
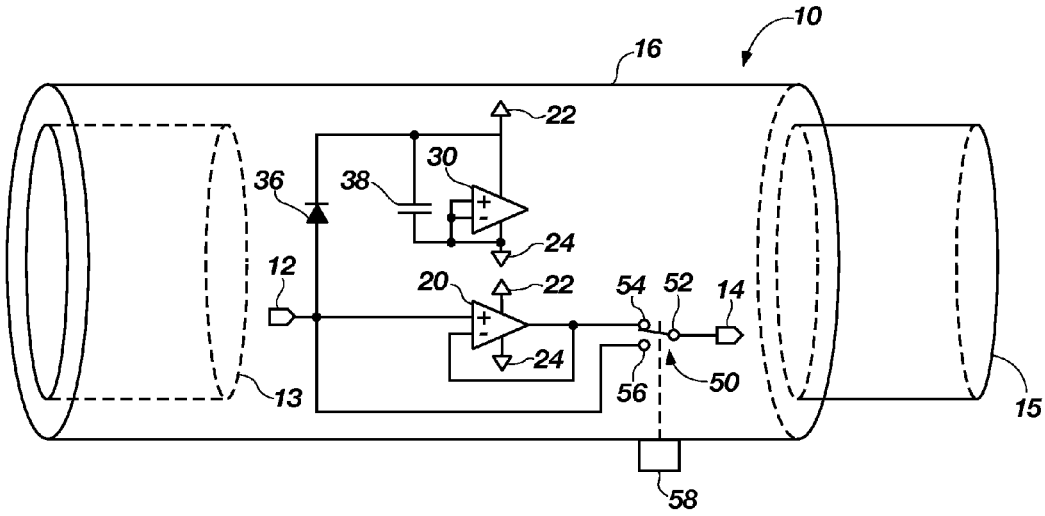
FIG. 1 illustrates an amplifying connector with an input signal-to-power generating circuit and a single pole double throw switch to bypass the amplifier in accordance with an exemplary embodiment of the present invention.

Reference will now be made to the exemplary embodiments illustrated, and specific language will be used herein to describe the same. It will nevertheless be understood that no limitation of the scope of the invention is thereby intended.

DETAILED DESCRIPTION

The following detailed description of exemplary embodiments of the invention makes reference to the accompanying drawings, which form a part hereof and in which are shown, by way of illustration, exemplary embodiments in which the invention may be practiced. While these exemplary embodiments are described in sufficient detail to enable those skilled in the art to practice the invention, it should be understood that other embodiments may be realized and that various changes to the invention may be made without departing from the spirit and scope of the present invention. Thus, the following more detailed description of the embodiments of the present invention, as represented in the figures, is not intended to limit the scope of the invention, as claimed, but is presented for purposes of illustration only to describe the features and characteristics of the present invention, to set forth the best mode of operation of the invention, and to sufficiently enable one skilled in the art to practice the invention. Accordingly, the scope of the present invention is to be defined solely by the appended claims.

Generally speaking, the present invention comprises an amplifying connector (or cable) that functions, among other things, to provide signal buffering on a cable. The amplifying connector buffers or amplifies the generated signal from the source (electronic device) (preferably at a location close to or proximate the source (e.g., at a beginning or initial segment of the cable)) to reduce the effects due to impedance of the cable and/or other components, and to maintain, as much as possible, the purity of the signal fidelity along the length of the cable. Maintaining the purity of the signal fidelity, as used herein, may more accurately be described as minimizing the phase distortion in the buffered (depending upon the length of the cable) signal caused by the impedance of the cable, as well as reducing signal attenuation at higher frequencies relative to signal attenuation at lower frequencies. The phase distortion of the signal at the end of the cable is significantly reduced relative to a signal in a similar cable not equipped with a buffering amplifying connector as set forth herein. For example, in some cases phase distortion can be reduced by 30% as compared to similar cables without an amplifying connector.

With respect to electrical musical instruments, for example, the amplifying connector can be mounted in-line with the cable. The amplifying connector can include a unity gain buffer or active buffer that provides many advantages, such as reducing or even eliminating the phenomena of "tone sucking" when a pedal is connected after the guitar. This enables the pedal to be used without substantially limiting the frequency range of the coils in the magnetic pickup by presenting a low-impedance to those coils. With an active buffer between the guitar coils and the pedal, any lower impedance presented by the pedal will not substantially interfere with the frequency response of the guitar coils.

Providing an amplifier within a cable, such as within in a connector mounted in-line within a segment of a cable (e.g., at an end of a cable that plugs into an electronic source device (e.g. a musical instrument)) can provide advantageous signal buffering capabilities. For example, this enables the amplifying connector or amplifying cable to be reused for any electronic device configured to use the connector or cable, respectively. Providing an amplifier in a connector on-board within a segment of a cable allows the cable to be used by many different types of electronic devices (e.g., electric guitars), and can be a more efficient and cheaper alternative to placing the amplifier on the electronic device, which can only be used by that device (a single device). In addition, the amplifying connector of the present invention may provide a more efficient and inexpensive mechanism to buffer electrical signals between electronic devices.

Although cables for use with electronic devices in the form of musical instruments are specifically discussed herein, this is not intended to be limiting in any way. Indeed, other types of cables and components are envisioned that utilize the concepts taught and discussed herein. For example, a cable for high definition (HD) television signal may be formed in accordance with the present invention (e.g., in a battery-less or batter-powered amplifying connector). In one aspect, the HD signal may be digitally modulated, wherein tapping a small amount of energy to power a regenerative amplifier may not substantially affect the signal-to-noise ratio of the signal. An error correction device in the receiver may compensate for any small loss of energy used to power the amplifier. In another aspect, the effect may be accomplished using a battery powered amplifying connector. In other examples, an amplifying connector may allow for regeneration and buffering of signals over long distance cables. In still another example, Ethernet cables may be formed in accordance with the present invention, such as where the amplifier draws power from the Ethernet signal and then the amplifier buffers the signal so it can drive a longer cable. One skilled in the art will recognize that other types of cables, not specifically identified herein, may also be formed in accordance with the present invention.

With reference to FIGS. 1-10, illustrated are several different embodiments of amplifying connectors in accordance with the present invention. Many of these embodiments comprise common components, which are designated by like numerals throughout. With reference to FIG. 1, shown is an exemplary amplifier in an exemplary amplifying connector (buffering connector or filtering connector) 10, which may use an exemplary operational amplifier (op amp) 20 configured as a unity gain buffer. The op amp may have an output, a non-inverting (positive) input, an inverting (negative) input, a positive supply voltage terminal 22, and negative supply voltage terminal 24. The positive supply voltage terminal provides a positive voltage connection to power the op amp and the negative supply voltage terminal provides a negative voltage connection to power the op amp. In a unity gain configuration the op amp output is coupled to the op amp negative input with an electrical short or extremely low resistance (typically less than 2 ohms). The source signal input 12 is coupled to the op amp non-inverting input and the buffered signal output 14 is coupled to the op amp output. Historically op amps required 5V, 3.3V, or 2.5V on the positive supply voltage terminal, and −5V, −3.3V, or −2.5V on the negative supply voltage terminal to operate. The relatively large voltage requirements has limited the use of an in-line amplifier due to the substantial power requirements. With recent developments, op amps can be powered with voltages as low as 100 to 200 mV, thereby limiting the amount of power used in the amplifying connector to a level that can be supplied using batteries for a reasonable time period.

Using a unity gain buffer as an amplifier can buffer the input signal. Because the input of the unity gain buffer has a relatively high impedance (measured in parallel with the input circuit), the load on the input circuit (pickup coils) due to the op amp may be negligible to the input circuit. In addition, the output of the unity gain buffer has an output impedance (measured in series with the output circuit) which may not substantially load the output circuit. The unity gain buffer can insulate the effects of the input circuit and the output circuit from each other. Gain can be defined as output voltage divided by input voltage. Unity gain may have a tolerance within about +/−25% of true unity. For example, an input voltage of 1 V may have an output voltage between 0.75 V and 1.25 V and still be considered a unity gain amplifier.

The amplifying connector (or connector) 10 can include a connector input 13 and a connector output 15. The connector input and connector output may be called a signal line. The connector may also have a common connection or ground connection that may provide a reference for the signal voltage. The amplifying connector may be embodied in a connector body 16, which can refer to the physical structure that encloses and supports the amplifying circuitry and various components of the amplifying connector. Alternatively, the amplifying connector can be embodied along or within a cable without a dedicated connector body, as long as the various circuitry or other components are adequately supported with one or more structures, that may include components of the cable.

The connector input and the connector output, or connector ends, can use a male or female type connector. The connector ends can provide the physical connection to devices and cables with corresponding features, so the connector may pass an electrical signal from a device or cable on the input to a device or cable on the output.

Figure 11:
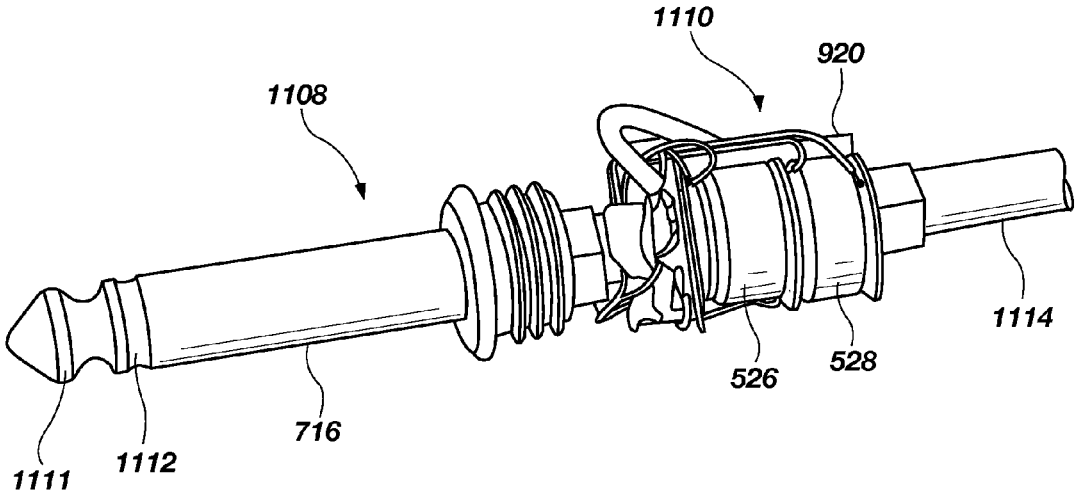
FIG. 11 illustrates a side view of an amplifying connector powered by batteries in accordance with an exemplary embodiment of the present invention.

As shown in FIG. 11, an exemplary end connector (in this case a male adapter) 1108 may be operable with a standard mono ¼ inch receptacle or jack used for audio connections. The connector ends may have a signal connection 1111 and a ground connection 716 with the signal connection separated from the ground connection with an electrical insulator 1112. A ⅛ inch adapter operable with a ⅛ inch receptacle or jack, an RCA connector, an Ethernet connector, or other similar connectors may also be used. The connector may also be used for audio, telecommunications, and medical applications.

Referring back to FIG. 1, the op amp 20 and its associated amplifying components may be enclosed and supported within the connector body 16. A power supply circuit may be used to provide the power for the op amp. The power supply may be operable within the connector body and the op amp positive supply voltage terminal 22 and the op amp negative supply voltage terminal 24. The power supply and op amp may use circuit components that draw low power and operate in a low power state.

In one exemplary embodiment, the power supply may use an input signal-to-power generating circuit. The input signal-to-power generating circuit may draw a portion of the voltage or current from the input signal generated by the source electronic device and use that voltage or current to power the op amp. The voltage drop in the input signal due to the input signal-to-power generating circuit may be approximately 0.1 V+/−0.05V. The input signal-to-power generating circuit may provide power without any batteries or an externally dedicated power signal. The input signal-to-power generating circuit can operate with various levels of inputs voltages. For example, in some embodiments the input signal-to-power generating circuit can power the op amp using voltages less than 1 V, and as low as about 300 mV. In other exemplary embodiments, the voltage levels may be higher than 1V, such as between 1V and 10V. The input signal-to-power generating circuit can use a diode 36 and a capacitor 38. The diode can be used to rectify the voltage signal for either a positive voltage (positive power rail) or a negative voltage (negative power rail). A diode can be used to rectify both the positive and negative portions of the input signal. Using a single diode may use less power from the input signal than dual diodes. As shown in FIG. 1, the diode rectifies the positive voltage. The capacitor can hold the voltage of the rectified signal at a relatively constant voltage. The diode and capacitor can act as a direct current (DC) power supply.

Traditionally diodes had a junction voltage of 0.7 V, so the diode would pass minimal current through the diode until the voltage signal equals or exceeds the junction voltage. As technology has improved, a diode's junction voltage may be as low as 0.2 V (e.g., exemplary diodes known as Schottky diodes), which allows low voltage signals to be used in power supplies. With op amps capable of being powered with 0.1 V and diodes with a junction voltage of 0.2 V, an input voltage of less than 0.3 V (300 mV) can be used to power the op amp of the unity gain amplifier using the input signal-to-power generating circuit. Because lower frequencies picked up by the guitar pickup can generate more voltage than higher frequencies, the amplifier response to lower frequencies may be better than higher frequencies using the input signal-to-power generating circuit.

A current or voltage limiting circuit may not be needed because the input signal from a device, such as an electric guitar, may only be capable of producing low voltage signals. Otherwise, if the device can generate a high voltage signal, a protection circuit mechanism can be employed to protect the op amp, capacitor, and other components sensitive to high voltage.

Commercial off-the-shelf op amps are often packaged with multiple op amps internal to the package. The input (inverting and non-inverting) connections may be coupled together to prevent inference and noise from any unused op amps on the working op amp, such as unused or inactive op amp 30 on working op amp 20.

The connector 10 can also include a switch 50 to bypass the op amp and unity gain buffer circuit and couple the connector input 13 to the connector output 15. The switch may be selected from a toggle switch, a rocker switch, a rotary switch, a push-button switch, or any others known in the art. The switch may be a single pole, double throw switch. A pole 52 may be coupled to the connector output 15 and a first throw position 54 couples the pole to the amplifier output, and a second throw position 56 couples the pole to the connector input 13. The switch 58 may be operable by a user on the connector body to throw the position on a single pole.

An advantage of a battery-less amplifying connector which acts as a buffer between guitar coils and other remaining devices can be the amplifying connector's small size. With no battery or dedicated power supply required, the amplifying connector can fit into and be supported about the cable with little or no perceived bulkiness. In addition, a pass-through rotary switch can be implemented in the cable that, when turned one way, disconnects the guitar signals from the amplifier and allows true bypass to the pedal or final amplifier. When the rotary switch is turned another way, the switch connects to the amplifier and the amplifier may be powered by the input signals and also present a buffered (low-impedance) version of the input signal on the amplifier's output. The rotary switch may fit into the cable so the cable's profile may not change.

Figure 2:
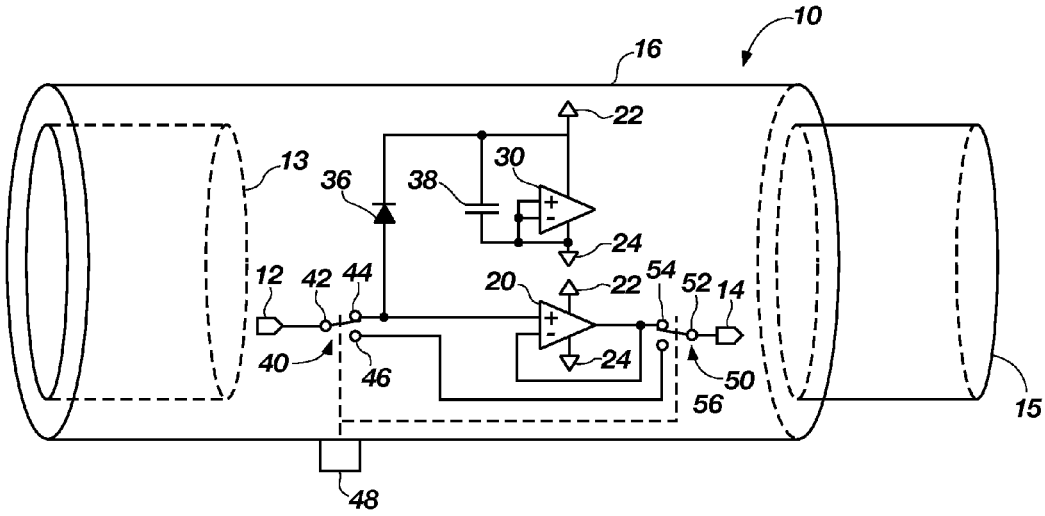
FIG. 2 illustrates an amplifying connector with an input signal-to-power generating circuit and a double pole double throw switch to bypass the amplifier in accordance with an exemplary embodiment of the present invention.

In another exemplary embodiment as illustrated in FIG. 2, the switch may comprise a double pole, double throw switch, wherein a first pole 42 may be coupled to the connector input 13 and a second pole 52 is coupled to the connector output 15. A first throw position 44 and 54 couples the first pole to the amplifier input and the second pole to the amplifier output, and a second throw position 46 and 56 couples the first pole to the second pole. The switch 48 can be operable by a user on the connector body to throw the position on both poles.

Figure 3:
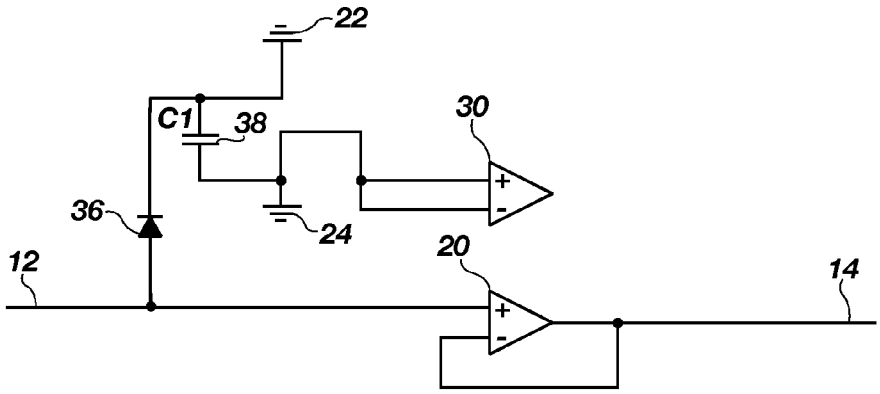
FIG. 3 illustrates a schematic diagram of an amplifying connector with a single diode clamp input signal-to-power generating circuit in accordance with an exemplary embodiment of the present invention.

In another exemplary embodiment as illustrated in the schematic diagram of FIG. 3, the connector can use a unity gain amplifier and input signal-to-power generating circuit without a switch. Each connector end can use a ¼" male receptacle or other type.

Figure 4:
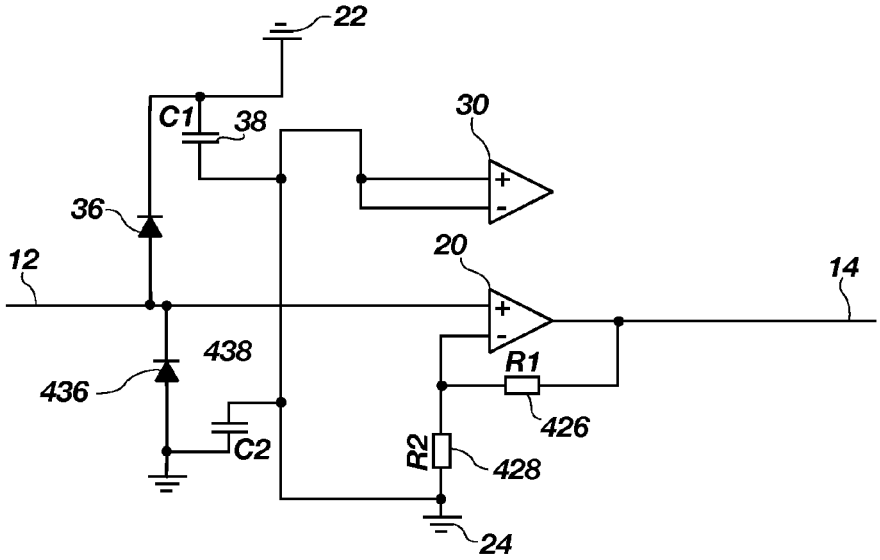
FIG. 4 illustrates a schematic diagram of an amplifying connector with a dual diode clamp input signal-to-power generating circuit in accordance with an exemplary embodiment of the present invention.

In another configuration, the amplifier can use a feedback resistor to increase the gain beyond unity (one), and use two diodes to rectify both the positive and negative input voltages, as illustrated in the schematic diagram of FIG. 4. A feedback resister R1 426 between the op amp inverting input 12 and op amp output 14 can be used to increase the gain along with an inverting input resistor R2 428 between the op amp inverting input and a ground connection 24. The feedback resistor and inverting input resistor may provide a gain represented by the formula: 1+R1/R2. For example, if R1 is 10 KΩ and R2 is 1 KΩ, then the gain of the amplifier will be 1+10 KΩ/1 KΩ or 11.

Rectifying both the positive and negative input voltages can utilize two diodes and two capacitors. A first diode 36 can rectify a positive input voltage with a first capacitor 38 maintaining charge and a nearly constant voltage for a positive voltage supply. A second diode 436 can rectify a positive input voltage with a second capacitor 438 maintaining charge and a nearly constant voltage for a positive voltage supply. A single diode-capacitor power supply can use less power than a dual diode-capacitor power supply. A dual diode-capacitor power supply can provide a stable differentiated power supply.

Figure 5:
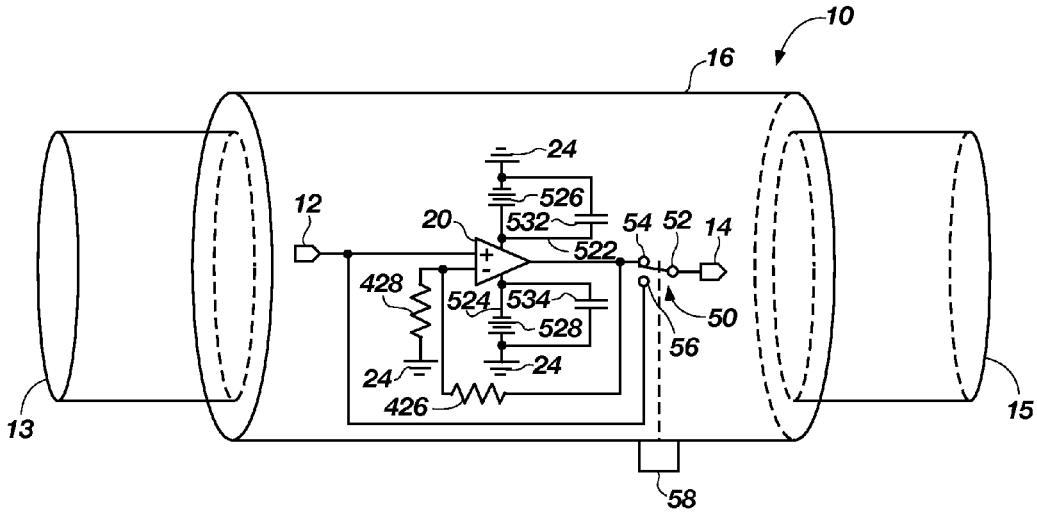
FIG. 5 illustrates an amplifying connector powered by batteries and a single pole double throw switch to bypass the amplifier in accordance with an exemplary embodiment of the present invention.

In another exemplary embodiment of an amplifying connector, the op amp or amplifier may be powered by small batteries, such as hearing aid batteries (AG13 or AC13), as illustrated in FIG. 5. The batteries can be selected that generate a suitable voltage (e.g., 1.4 V) and that have a suitable battery life (e.g., that of about 130 mA-hours). The low-powered amplifier can be configured to consume 10-20 microamps (μA). The amplifier can be configured to use about 30 microwatts (μW) of power without an input signal or input load, and the amplifier may be configured to use about 60 microwatts (μW) of power with an input signal (calculated using an average 1 kHz signal). The batteries can power the amplifying connector for an extended duration before needing to be recharged or replaced.

Figure 7:
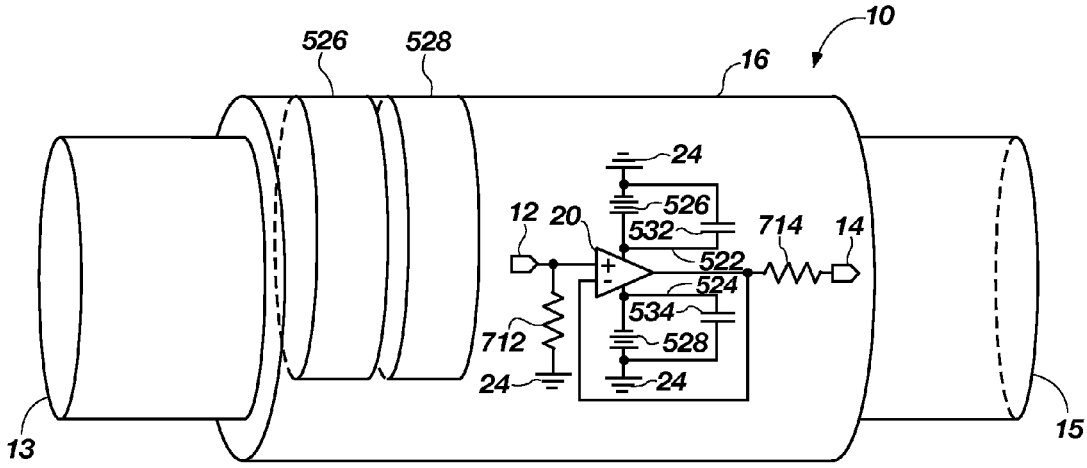
FIG. 7 illustrates an amplifying connector powered by batteries and battery and the placement of batteries in accordance with an exemplary embodiment of the present invention.

As shown, the op amp positive power supply may include a first battery 526 in parallel with a first capacitor 532. A first positive battery terminal can be coupled to an op amp positive supply voltage terminal 522 and a first negative battery terminal can be coupled to a ground connection 24. The op amp negative power supply can include a second battery 528 in parallel with a second capacitor 534. A second negative battery terminal can be coupled to an op amp negative supply voltage terminal 524 and a second positive battery terminal may be coupled to the ground connection. The capacitors 532 and 534 across the batteries 526 and 528 can limit the high frequency (greater than 20 MHz) oscillations or noise on the power supply. The batteries can be rechargeable or replaceable. The connector body 16 can include a connection and mechanism to charge the batteries. The connector body may include a mechanism or functionality to remove and replace the batteries, as illustrated in FIG. 7.

In another exemplary embodiment, a rechargeable battery remains inside of the jack or connector body and provides power to the amplifier. A diode may tap off of the center input signal of the jack where audio is normally propagated. The cathode side of the diode can be connected to the positive terminal of the rechargeable battery. To charge the batteries, the jack can be plugged into a device that provides power over the center conductor where the device forward biases the diode which then provides charging current for the rechargeable battery.

Figure 6:
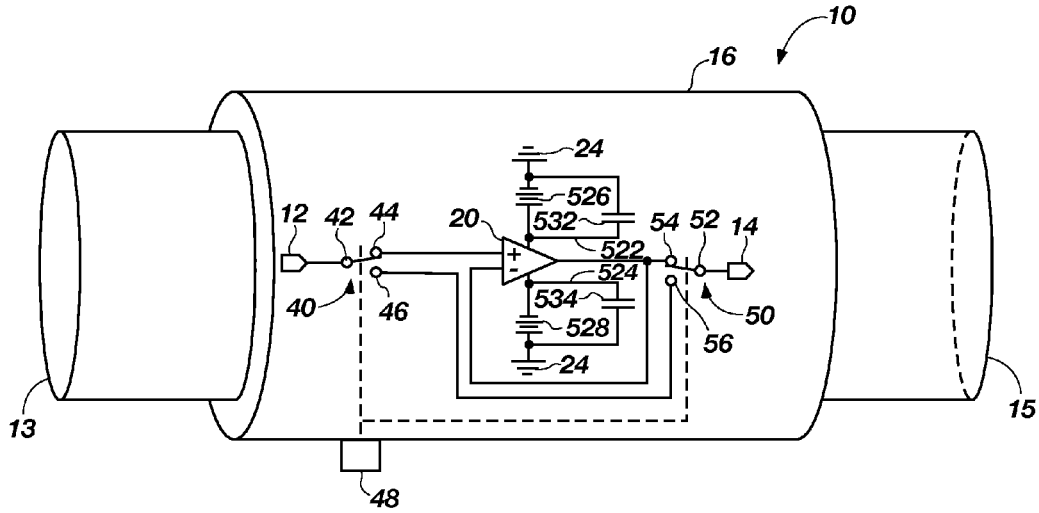
FIG. 6 illustrates an amplifying connector powered by batteries and a double pole double throw switch to bypass the amplifier in accordance with an exemplary embodiment of the present invention.

As shown in FIG. 5, the op amp of the amplifier may function as unity gain buffer, when the feedback resistor 426 approaches 0Ω (ohms). The feedback resistor and inverting input resistor 428 can be selected to generate an amplifier gain other than unity. A single pole, double throw switch 58 may be used to bypass the amplifier in a configuration using a battery. As shown in FIG. 6, a double pole, double throw switch 48 may be used to bypass the amplifier in a configuration using a battery. In another embodiment, additional poles can be used to disconnect the batteries from the op amp of the amplifier when the amplifier is bypassed. A switch may be used to disconnect the batteries from the op amp of the amplifier without an amplifier bypass.

Figure 8:
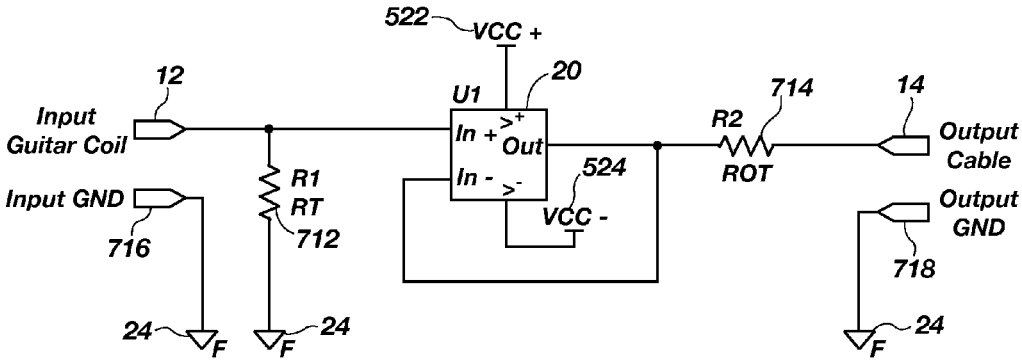
FIG. 8 illustrates a schematic diagram of an amplifying connector powered by batteries with an input resistor and an output resistor in accordance with an exemplary embodiment of the present invention.
Figure 8:
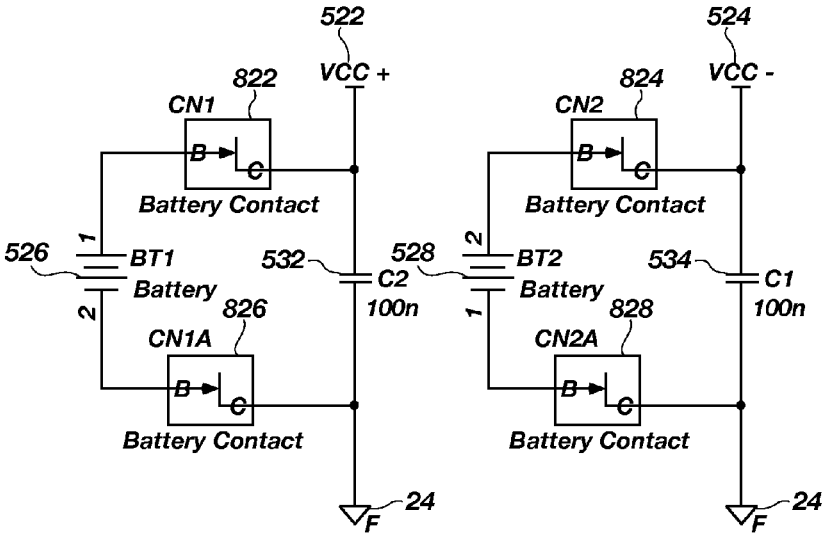

As shown in FIG. 8, the amplifier may use a non-inverting input resistor 712 as a high frequency filter or low pass filter. The non-inverting input resistor can be coupled to the op amp non-inverting input and the ground connection. The non-inverting input resistor can have a value of approximately 470 kΩ. Providing a low pass filter on the input may eliminate harmonics in the signal which may distort the quality of the sound or signal passing through the connector. The amplifier can use an output resistor 714 as a protection mechanism for the amplifier if the output connection of the amplifier is accidentally inserted or connected into the input signal generating device, or musical instrument. In other words, the output resistor protects the amplifier circuitry from an improper connection. The output resistor can have a value of 1 kΩ or less.

Figure 9:
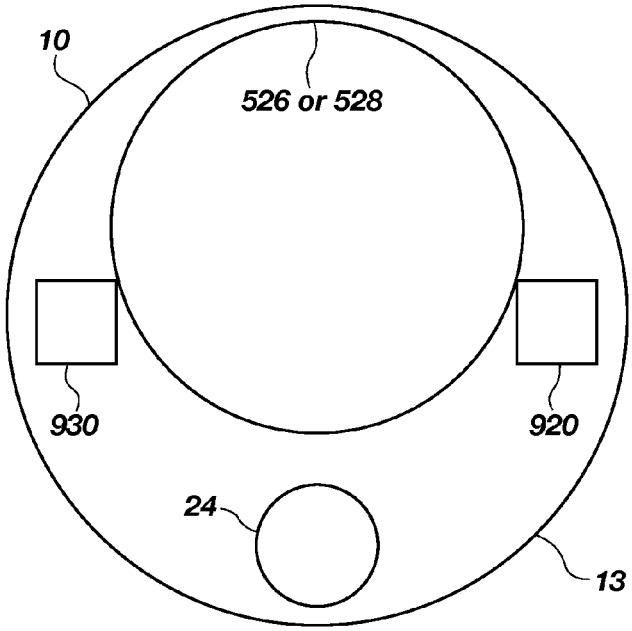
FIG. 9 illustrates a cross sectional view of an amplifying connector powered by batteries in accordance with an exemplary embodiment of the present invention.
Figure 10:
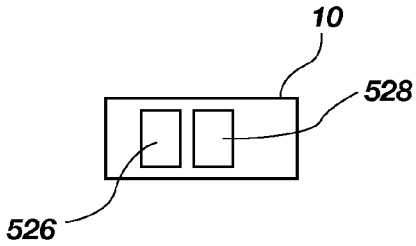
FIG. 10 illustrates a side view of an amplifying connector powered by batteries in accordance with an exemplary embodiment of the present invention.

As shown in FIGS. 8-10, the exemplary amplifying connector 10 can have a source signal input 12 for an input signal generated from an input device, such as a guitar coil, and an input ground connection 716 used for an input signal reference. The amplifying connector may have a buffered signal output 14 for the amplified input signal generated by the amplifying connector, and an output ground connection 718 used for an output signal reference. A cable may separate the output connection from the op amp output. The positive supply battery 526 and negative supply battery 528 may have battery contacts 822, 824, 826, and 828 that may provide a mechanical structure for electrically coupling the batteries to the op amp.

The amplifying connector may have a small size. The diameter of the connector may have a diameter between approximately 0.25 inches 2 inches and a length between approximately 0.5 and 4 inches. As shown in FIG. 9, a battery 526 or 528, a printer circuit board (PCB) 920 and 930, and ground wire can fit within a 0.45 diameter plug or connector. The PCB is used to mount the op amp and other electrical components used in the amplifier. The connector 10 may have a length of about one inch. The batteries 526 and 528 can be inserted and stacked into the side of the connector. The batteries and amplifying components may fit the small form-factor requirements of the connector.

FIG. 11 shows an exemplary embodiment of an end connector 1108 (in this case a male ¼" adapter) of an amplifying cable 1114, wherein the end connector couples to a source device. The end connector 1108 comprises an integrally formed amplifying connector 1110, wherein the amplifying connector 1110 is shown as being integrally formed with and connecting the signal connection 1111 and ground connection 716 and the cable 1114 at the input end of the amplifying cable. The end connector 1108 of the amplifying cable 1114 is shown without a cover to provide a view of the components of the amplifying connector 1110.

In this exemplary embodiment, integrally formed means the amplifying connector is physically part of or supported about the cable. In some aspects, the amplifying connector may be configured such that it cannot be readily detached from the cable (e.g., without specialized tools, such as a soldering iron). The PCB 920 can provide structural support for the amplifier components and the battery or batteries. Using circuit board material to mount the batteries perpendicular to the body of the connector may give the connector a small diameter and length (minimum profile). The series combination of the batteries can produce a higher voltage. Multiple batteries 526 and 528 can increase the length of the circuit board as the batteries are mounted vertically in a cut-out slot in the board. Electrical terminals soldered to the board make contact with the batteries. Alternatively, the board may have conductive plating on the inner sides of the slots to make contact with the batteries. Although two batteries are shown, this is not intended to be limiting in any way.

In another configuration, the batteries may be stacked in series with each other in between spring mountings and the case of the battery holder. The battery holder can contain the small circuit board with the amplifier mounted on it. The spring retention in the battery holder can make a good electrical contact and allow for the batteries to be easily changed.

The amplifier can reduce or eliminate the effects of the load of the cable and loading components and devices, such as the effects pedal, so placing the amplifier at the input side of the connector may improve the quality of the sound generated from the input signal.

Figure 12:
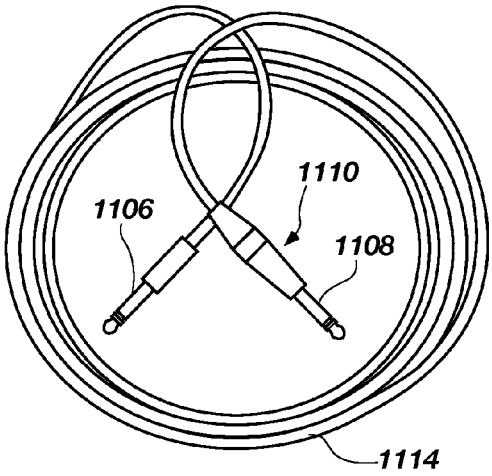
FIG. 12 illustrates an amplifying connector configured as part of a cable in accordance with an exemplary embodiment of the present invention.
Figure 13:
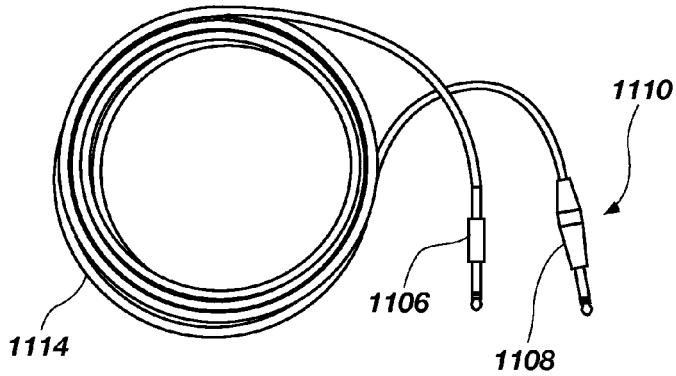
FIG. 13 illustrates an amplifying connector as part of a cable in accordance with an exemplary embodiment of the present invention.

FIGS. 12 and 13 show an exemplary embodiment of the amplifying cable 1114 of FIG. 11, with all of the components intact. The amplifying cable 1114 comprises an amplifying connector 1110 embodied within an end connector 1108 that couples with a source device (e.g., guitar), opposite an end connector 1106 that couples with an output device (e.g., speaker).

Figure 14:
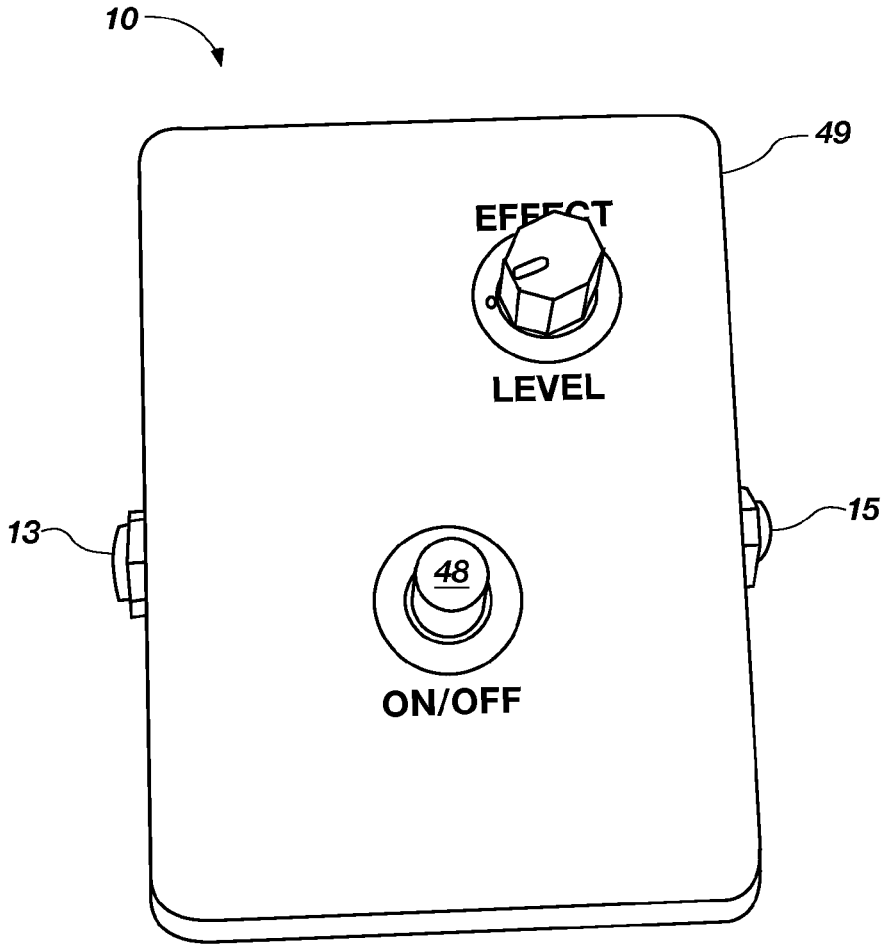
FIG. 14 illustrates an amplifying connector configured in a box in accordance with an exemplary embodiment of the present invention.

FIG. 14 shows another exemplary embodiment of an amplifying connector 10 not embodied within an end connector of a cable. In this embodiment, the amplifying connector 10 comprises a connector body in the form of a box intended to be coupled between an input device and an output device using a cable. The amplifying connector comprises a push button switch 48 and a potentiometer (a variable resistor) for varying the gain of the amplifying connector. The connector may use different shapes, such as a cylinder and box.

In still another exemplary configuration, the amplifying connector may include a small Digital Signal Processing (DSP) chip placed on the PCB in the connector. The DSP chip may be approximately the same size as the op amp circuit.

The DSP chip may contain an input amplifier and analog to digital converter (ADC) for sampling the signal from the guitar coils. An output amplifier may be provided by the DSP chip which may eliminate the need for an external amplifier. The DSP architecture can also contain a processor and hardware implementation for performing digital filters, digital signal transforms and many signal processing functions which can change the tone and spectral content of the signal. The DSP chip may allow for special audio effects to be created in the cable, which would then be amplified before leaving the DSP chip to drive the cable. The DSP chip may be powered using the same power supply illustrated in FIG. 5.

A cable can have a large capacitance per foot which, after a long distance, amounts to a large load capacitance for any signal to drive. In one example embodiment, a guitar cable having a length of 20 feet can have a capacitance of approximately 2000 pF, which has a significant effect on audio signals near the low range (20 Hz) relative to audio signals near the high range (20 KHz). Amplifiers can be well suited to driving cable capacitance because of their low-impedance drive, although the amplifier should be chosen carefully so that the amplifier's phase margin does not adjust radically due to the capacitive load, as a radical adjustment can cause instability problems.

The formula for driving a cable with a certain capacitance can be represented by $dV/dt=I/C$, where I is the current charging the capacitance, C is the capacitance value and dV/dt is the time rate of change of the voltage driving the capacitance. The formula states that more current may be used in order to drive a signal of a higher voltage level if the capacitance is increased. As guitar coils typically have an output impedance of about 2K ohm, the amount of current the coils can drive is very small and generally they will not drive a long length of cable without forcing a slow rise in voltage (dV/dt) on the signal as shown in the above equation. Also, a phase change due to the high output impedance of guitar coils (the 2K ohm output impedance) can combine with the high capacitance of the cable to produce a phase shift versus frequency (Tan−1 (frequency/RC)=phase)) which is very non-linear and detrimental to audio quality. The impedance presented by a cable capacitance of 2000 pf at 20 KHz is $1/(2\pi RC)=3980$ ohms. This is approximately double the coil output impedance of 2 kΩ (Ohms). This will result in a voltage divider, placing about two thirds (3980/(3980+2000)) of the coils output voltage on at the end of the cable when driving impedance loads for 20 KHz signals. Of course at 20 Hz the impedance is 1/1000 of this value, so much more voltage at 20 Hz is present (almost 90%). The variation in amplitude and phase can create problems in driving the longer cable.

Therefore, the advantage of a low-impedance amplifier drive (3 ohm output or less from most amplifiers) reduces the problems described and provides adequate current in the time required. This has the effect of minimizing phase shift causing phase distortion and providing a substantially equivalent load over the acoustic frequency range (20 Hz to 20 KHz) to keep the signal fidelity as pure as possible along the cable. The substantially equivalent load reduces signal attenuation at higher frequencies relative to signal attenuation at lower frequencies to provide for an even response across the acoustic frequency range. Having an amplifier inside or otherwise supported about the cable or on or about any connectors operable with the cable, is extremely advantageous when one has to drive a signal across any length of cable from a first electronic device to a second electronic device, where the second electronic device is stationed a distance from the first. In the case tested, the length of cable needed to reach the amplifier driven by guitar coils caused phase distortion and amplitude irregularity. A driven signal, without the benefits of an amplifying connector, that reaches a typical powered amplifier will not be improved from the signal at the source. Rather, the phase distortion and amplitude irregularity occurring through the cable will simply be amplified again, which will provide no beneficial result. Thus, the amplifying connector of the present invention operable with the cable (e.g., residing inside the jack or connector of the cable) and located near the signal source provides significant advantages.

EXAMPLE ONE

In one test, a configuration of an exemplary powered cable comprising one exemplary embodiment of a present invention amplifying connector was found to provide and maintain significantly better signal fidelity over the length of the cable from a first electronic device to a second electronic device. A twenty (20) foot length cable was configured to comprise an amplifying connector located or positioned near the source end of the cable. The tested frequency response was 20 Hz-20 KHz, with a +/−0.5 dB variation in amplitude. The tested signal to noise ratio was 70 dB. As tested, prior art cables were incapable of providing such low variation in amplitude over the 20 Hz-20 KHz range.

It is to be understood that the above-referenced arrangements are only illustrative of the application for the principles of the present invention. Numerous modifications and alternative arrangements can be devised without departing from the spirit and scope of the present invention. While the present invention has been shown in the drawings and fully described above with particularity and detail in connection with what is presently deemed to be the most practical and preferred embodiment(s) of the invention, it will be apparent to those of ordinary skill in the art that numerous modifications can be made without departing from the principles and concepts of the invention as set forth herein. Accordingly, it is not intended that the invention be limited, except as by the claims set forth below.

The invention claimed is:

1. An amplifying connector operable with a cable electrically coupling first and second electronic devices, comprising:

an op amp forming an amplifier;

a low wattage power supply circuit operable with the amplifier, wherein the power supply circuit facilitates powering of the amplifier;

a connector output coupled to an amplifier output; and a connector input coupled to an amplifier input, wherein an input electrical signal on the connector input is buffered by the amplifier to generate an output electrical signal on the connector output having reduced effects caused by an impedance of the cable.

2. The amplifying connector as in claim 1, further comprising a connector body that provides physical support for the op amp, the low wattage power supply circuit, the connector output and the connector input.

3. The amplifying connector as in claim 1, wherein the amplifying connector provides adequate current in the time required to substantially maintain the purity of the signal fidelity along the cable between the first and second electronic devices.

4. The amplifying connector as in claim 1, wherein a length of cable is coupled between the amplifier output and the connector output.

5. The amplifying connector as in claim 2, further comprising a switch on the connector body configured to bypass the amplifier by directly coupling the connector input to the connector output.

6. The amplifying connector as in claim 5, wherein the switch comprises a single pole, double throw switch, wherein a pole is coupled to the connector output, wherein a first throw position couples the pole to the amplifier output, and a second throw position couples the pole to the connector input.

7. The amplifying connector as in claim 5, wherein the switch comprises a double pole, double throw switch, wherein a first pole is coupled to the connector input and a second pole is coupled to the connector output, wherein a first throw position couples the first pole to the amplifier input and the second pole to the amplifier output, and a second throw position couples the first pole to the second pole.

8. The amplifying connector as in claim 5, wherein the switch is selected from the group of a toggle switch, a rocker switch, a rotary switch, and a push-button switch.

9. The amplifying connector as in claim 1, wherein the op amp is configured as a unity gain amplifier.

10. The amplifying connector as in claim 1, wherein the power supply circuit is an input signal-to-power generating circuit and coupled to the amplifier input.

11. The amplifying connector as in claim 10, wherein the input signal-to-power generating circuit further comprises a diode clamp and capacitor.

12. The amplifying connector as in claim 2, wherein the power supply circuit includes a battery seated within the connector body.

13. The amplifying connector as in claim 1, wherein the power supply circuit includes a positive supply battery in parallel with a positive supply capacitor coupled to a positive op amp terminal of the op amp, and a negative supply battery in parallel with a negative supply capacitor coupled to a negative op amp terminal of the op amp.

14. An amplifying connector, comprising:

a connector body;

an op amp forming a unity gain amplifier supported within the connector body;

an input signal-to-power generating circuit supported within the connector body to power the op amp using a signal voltage of less than one volt;

a connector input on the connector body coupled to an amplifier input of the amplifier; and a connector output on a connector body coupled to an amplifier output of the amplifier, wherein an input electrical signal on the connector input is buffered by the amplifier to generate an output electrical signal on the connector output having reduced effects caused by an impedance of the cable.

15. An amplifying connector, comprising:

a connector having a signal line and a common line supported within a connector body;

an op amp forming a unity gain amplifier supported within the connector body;

a low power battery power supply operable within the connector body that powers the op amp, wherein the low power battery power supply is configured to draw less than 60 microwatts;

a connector input on the connector body coupled to an amplifier input of the unity gain amplifier; and a connector output on the connector body coupled to an amplifier output of the unity gain amplifier, wherein an input electrical signal on the connector input is buffered by the unity gain amplifier to generate an amplified output electrical signal on the connector output having reduced effects caused by an impedance of the cable.

16. The amplifying connector as in claim 15, wherein the low power battery power supply uses a plurality of batteries.

17. An amplifying cable electrically coupling first and second electronic devices, comprising:

a signal line and a common line;

an input connector with an input connector body integrally formed with and supported at a first end of the amplifying cable;

an op amp forming an amplifier having unity gain that is supported within the input connector body, wherein an amplifier input of the amplifier is electrically coupled to the signal line of the input connector;

a low voltage power supply circuit supported within the input connector body and electrically coupled to the op amp, wherein the power supply circuit facilitates powering of the op amp, and wherein the amplifier and the low voltage power supply circuit form an amplifying connector; and an output connector integrally formed on a second end of the amplifying cable and electrically coupled to an amplifier output of the amplifier through the signal line of the amplifying connector, wherein the amplifying connector receives an input electrical signal and generates an output electrical signal at the output connector having reduced effects caused by an impedance of the cable.

18. An amplifying cable electrically coupling first and second electronic devices, comprising:

a signal line;

an input connector having an input connector body;

an amplifying connector integrally formed with and supported along a length of the cable, the amplifying connector comprising:

an op amp forming a unity gain amplifier, the op amp having an amplifier input coupled to the input connector through the signal line;

a low voltage power supply circuit electrically coupled to the op amp, wherein the power supply circuit facilitates powering of the op amp; and an output connector coupled to an amplifier output of the op amp through the signal line, wherein the amplifying connector receives an input electrical signal and generates an output electrical signal at the output connector having reduced effects caused by an impedance of the cable.

19. The amplifying cable of claim 18, wherein the amplifying connector is integrally formed with and part of the input connector.

20. A method for reducing effects on an electrical signal caused by impedance within a cable, the method comprising:

providing an op amp forming an amplifier within the cable;

powering the op amp; and providing an input electrical signal that is buffered by the amplifier to generate an output electrical signal.

21. The method of claim 20, wherein said powering the op amp comprises drawing a portion of a voltage or current from an input signal generated by a source electronic device.

22. The method of claim 20, wherein the powering the op amp comprises powering the op amp with an on-board battery power supply.

* * * * *